US009067404B2

(12) United States Patent
Girard

(10) Patent No.: US 9,067,404 B2
(45) Date of Patent: Jun. 30, 2015

(54) INSERTION METHOD FOR INTRODUCING STAMPING FOILS INTO A SYSTEM THAT FEEDS THEM, AND DEVICE FOR IMPLEMENTING SUCH A METHOD

(75) Inventor: Olivier Girard, Bex (CH)

(73) Assignee: BOBST MEX SA (CH)

( * ) Notice: Subject to any disclaimer, the term of this patent is extended or adjusted under 35 U.S.C. 154(b) by 325 days.

(21) Appl. No.: 13/820,783

(22) PCT Filed: Aug. 31, 2011

(86) PCT No.: PCT/EP2011/004367
§ 371 (c)(1),
(2), (4) Date: Mar. 5, 2013

(87) PCT Pub. No.: WO2012/031711
PCT Pub. Date: Mar. 15, 2012

(65) Prior Publication Data

US 2013/0161367 A1 Jun. 27, 2013

(30) Foreign Application Priority Data

Sep. 8, 2010 (EP) ..... 10009336

(51) Int. Cl.
*B41F 19/06* (2006.01)
*B65H 20/00* (2006.01)
*B41F 13/03* (2006.01)

(52) U.S. Cl.
CPC ..... *B41F 19/064* (2013.01); *B65H 20/00* (2013.01); *B41F 13/03* (2013.01); *B65H 2301/522* (2013.01); *B41P 2233/10* (2013.01); *B41P 2219/20* (2013.01)

(58) Field of Classification Search
CPC ..... B65H 20/00; B65H 2301/522; B65H 2301/52202; B41F 13/03; B41F 19/064; B41P 2219/20; B41P 2219/22–2219/23; B41P 2233/10
USPC ..... 226/91–92
See application file for complete search history.

(56) References Cited

U.S. PATENT DOCUMENTS 3,770,175 A 11/1973 Lale-Demoz

FOREIGN PATENT DOCUMENTS

CH 516458 12/1971
FR 2 913 914 A1 9/2008

OTHER PUBLICATIONS

International Search Report dated Oct. 13, 20133 issued in corresponding International patent application No. PCT/EP2011/004367.

*Primary Examiner* — William E Dondero
(74) *Attorney, Agent, or Firm* — Ostrolenk Faber LLP

(57) ABSTRACT

An insertion method for introducing at least one stamping foil 410 into a foil drive system 440 of a stamping machine 1, wherein the drive system advances each foil 410 in a determined feed path. The method includes the steps of unwinding an end portion of each foil 410 over a given length, turning each end portion back on itself to constitute the free strand 413 of an open loop 414, unwinding each free strand 413 along the feed path by pulling the corresponding foil 410 from the inside of its loop 414, while partially restraining each free strand 413 as it deploys along the feed path.

19 Claims, 3 Drawing Sheets

INSERTION METHOD FOR INTRODUCING STAMPING FOILS INTO A SYSTEM THAT FEEDS THEM, AND DEVICE FOR IMPLEMENTING SUCH A METHOD

The present application is a 35 U.S.C. §§371 national phase conversion of PCT/EP2011/004367, filed Aug. 31, 2011, which claims priority of European Patent Application No. 10009336.8, filed Sep. 8, 2010, the contents of which are incorporated by reference herein. The PCT International Application was published in the French language.

BACKGROUND OF THE INVENTION

The present invention relates to a method that allows one or more stamping foils to be introduced into a system that advances the foil.

The present invention also relates to a device for implementing this insertion method.

The invention finds a particularly advantageous application in the field of stamping machines.

It is known practice for texts and/or patterns to be printed by stamping, that is by using pressure to apply to a sheet form medium , the colored or metalized film taken from one or more stamping foils which are commonly known as metalized foils. In the industry, such a transfer operation is usually performed using a vertical platen press into which the print supports are introduced sheet by sheet, while the foils are fed continuously via a foil drive system which advances them along a clearly determined feed path.

Traditionally, such a foil drive system combines a series of idling shafts which are installed along the entire feed path to guide the progress of the foils, with a number of advance shafts which are positioned in the downstream part of said feed path in order respectively to drive the forward movement of each of said foils. This in practice implies that, for their initial placement, each foil has to be partially wound around a great many elements in addition to passing through the platen press.

A good number of the idling shafts are difficult to access, especially those positioned in close proximity to the platen press. The same is true of the space between the plates of the press. In any event, the end result is that manual introduction of the foils proves to be a particularly complicated operation in such a drive system.

This is why insertion devices have been developed that are capable automatically of routing the foils from a starting point to a finishing point, both of which are relatively accessible. The starting and finishing points are situated respectively one on each side of the platen press.

Particularly well known is an insertion device which uses a bar mounted with a transverse translational mobility in a trajectory substantially parallel to the feed path of the foils. In concrete terms, in the region of the abovementioned start point, each foil is temporarily secured to the rod by means of adhesive tape. The rod then undergoes a mechanical translational movement along its movement trajectory, which causes the various foils to be pulled and therefore to deploy along their feed path. Once the finishing point has been reached, all the foils are detached from the rod by removing the adhesive tape.

This type of insertion device does, however, have the disadvantage of not being ergonomic enough given that the rod start and finishing points are in fact rarely easy to access. Indeed usually the starting point is situated in the lower part of the platen press, that is to say in a region that is particularly cluttered. The finishing point itself is positioned in the high part, that is to say in a region that is intrinsically difficult to access, to the point where it is often necessary to climb up on top of the platen press in order to reach it. Finally, attaching and detaching the foils to and from the rod are awkward operations because they have to be performed individually for each foil and because they entail manipulating adhesive tape each time.

SUMMARY OF THE INVENTION

Hence, the technical problem that the subject of the present invention attempts to solve is that of proposing an insertion method for introducing at least one stamping foil into a foil drive system of a stamping machine, said drive system having the task of advancing each foil in a determined feed path, which insertion method would make it possible to avoid the problems of the prior art by notably offering vastly improved ease of implementation.

The solution to the stated technical problem consists, according to the invention, in the insertion method comprising the steps of:

- unwinding an end portion of each foil over a given length,
- turning each end portion of foil back on itself to constitute the free strand of an open loop,
- deploying each free strand along the feed path by pulling the corresponding foil from the inside of its loop,
- partially restraining each free strand as it deploys along the feed path.

That each free strand is partially restrained means that the strand is never completely immobilized or even held firmly. However, each free strand is held enough that it remains under tension, while at the same time it enjoys a certain freedom to move so as to allow it to slip progressively as it gradually deploys. The objective here is to prevent any excessive movement of each free strand, that is any movement at a speed higher than the speed at which the loop associated with it is pulled. The purpose of this is to guarantee perfect positioning of the corresponding foil along the feed path.

It must also be understood that throughout this text, the idea of a foil drive system denotes both a drive system in its entirety and a simple portion of such a system.

According to one specific feature of this insertion method, each free strand is restrained by applying to it a suction force which is directed in a direction substantially the opposite of the direction in which said free strand deploys at the start of introduction.

In fact, the suction is regulated to generate restraint the intensity of which is enough to partially restrain each free strand as it deploys, while at the same time remaining not enough to pull said free strand back.

In any event, the invention also relates to a device for implementing the insertion method described hereinabove, namely an insertion device for introducing at least one stamping foil into a foil drive system of a stamping machine, said drive system having the task of advancing each foil along a determined feed path.

This insertion device comprises, on the one hand, means capable of holding each foil in an insertion position, in which the end portion of said foil is turned back on itself to constitute the free strand of an open loop, and, on the other hand, means capable of deploying each free strand along the feed path by pulling the corresponding foil from the inside of its loop, and the holding means are also capable of partially restraining each free strand as the deployment means are implemented.

Contrary to what is done in the prior art, the implementation of the deployment means of the invention does not lead to a movement of the foil concomitant with the paying-out from the reel on which it is stored, but leads to a progressive deployment of the previously unwound free strand, without there necessarily being any additional unwinding of the foil. The foil is not pulled by its end, that is by a region of fixed contact of the foil, but is pulled from inside a loop, that is to say on a sliding region of contact. What this means is that, in the case of the invention, there is no need to establish a rigid connection between each foil and the deployment means used, and that a sliding connection, combined with the restraining action of the holding means, is enough to temporarily couple the foil and said deployment means.

The invention as thus defined has the advantage of not requiring any rigid connection between foils and deployment means. That means that it is possible to dispense with the attaching and detaching operations, which operations, are particularly awkward and require a relatively high level of accessibility in order to be able to be performed across the entire width of the machine. In any event, it is in this respect that the phase of introducing the foils into their drive system is ultimately significantly simplified.

The present invention also relates to the features that will become apparent during the course of the description which follows, and which should be considered in isolation or in any technically feasible combination.

This description, which is given by way of nonlimiting example, is intended to provide a better understanding of the substance of the invention and of how it may be embodied. The description is also given with reference to the attached drawings, in which:

DESCRIPTION OF AN EMBODIMENT

For the sake of clarity, the same elements have been denoted by identical references. Likewise, only elements essential for understanding the invention have been depicted, and then only schematically and not to scale.

Figure 1:
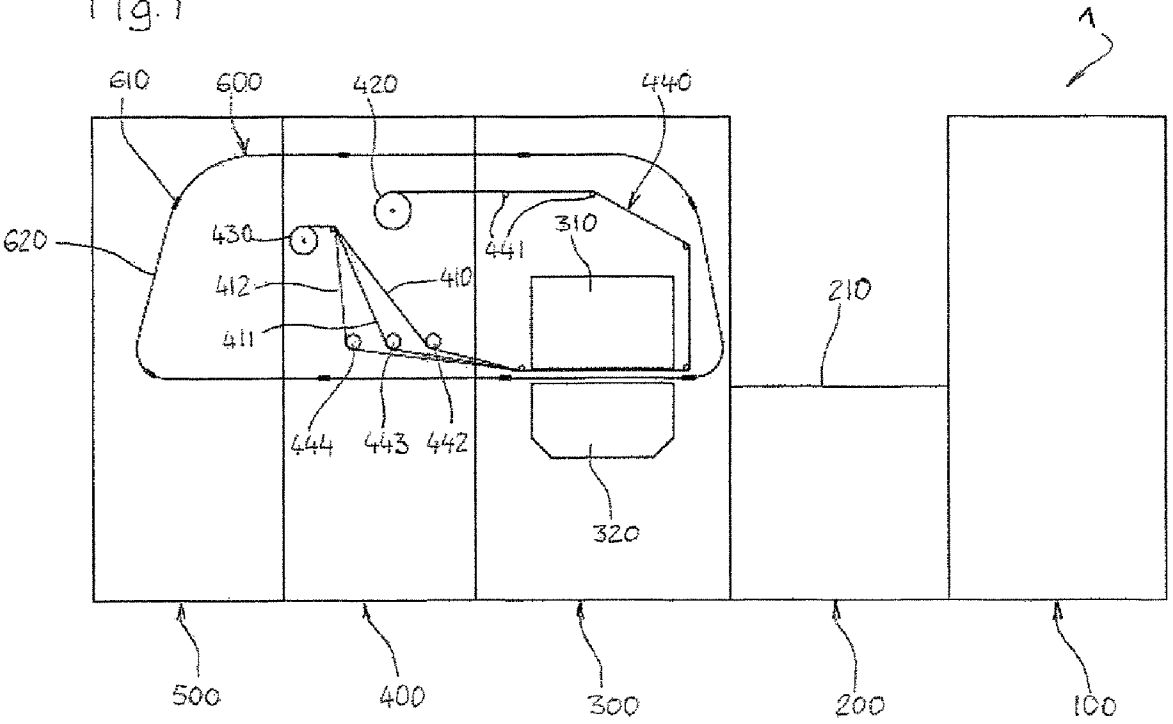
FIG. 1 illustrates a known stamping machine into which a foil insertion device according to the invention is incorporated.

FIG. 1 depicts a hot stamping machine 1 which is intended for customizing cardboard packaging for the luxury goods industry. Commonly known as a gilding machine, this stamping machine 1 is conventionally made up of a number of workstations which are juxtaposed with, but interdependent on, one another in order to form a unit assembly capable of processing a series of supports in sheet form. There is thus a feeder 100, a feed table 200, a platen press 300, a foil feed and recovery station 400, and a delivery station 500. A conveying device 600 is also provided to move each sheet along individually from the exit of the feed table 200 to the delivery station 500, including through the platen press 300.

The various parts 100, 200, 300, 400, 500, 600 of the stamping machine 1 are very well known from the prior art and will therefore not be described in detail here either in terms of their structure or in terms of their operation.

In this embodiment, chosen solely by way of example, the feeder 100 is fed via a pallet on which a plurality of sheets of cardboard are stacked. These sheets are successively taken off the top of the stack by a suction-type gripper member which transports them as far as the directly adjacent feed table 200.

At the feed table 200, the sheets are laid out in a layer by the suction-type gripper member, which means they are laid one after the other with a partial overlap. The whole layer is then driven along a plate 210 toward the platen press 300 by means of a belt-type conveyor mechanism. At the end of the layer, the lead sheet is systematically positioned accurately using front and side lays.

The workstation situated just after the feed table 200 is therefore the platen press 300. The latter has the function of applying to each sheet, by hot stamping, the metalized film which comes from three stamping foils 410, 411, 412 in this exemplary embodiment. The stamping operation proper is performed between a heated upper platen 310 which is fixed, and a lower platen 320 which is mounted with the ability to move in a reciprocating vertical movement.

Downstream of the platen press 300 is the foil feed and recovery station 400. As its name suggests, this station plays a dual role because it has the task both of feeding the machine with stamping foils 410, 411, 412 and of removing these same foils once they are spent.

In this particular embodiment, there are, specifically, three foils 410, 411, 412 which are managed independently of one another in terms of storage, unwinding, feed and recovery. Hence, each foil 410, 411, 412 is stored in wound form on its own feed reel mounted such that it can rotate, and here symbolized merely by the reel 420. Likewise, having passed through the platen press 300, each foil 410, 411, 412 is wound around its own take-up reel, mounted such that it can rotate, and once again embodied simply in the form of the reel 430.

Between its storage point and its take-up point, each foil 410, 411, 412 is driven along by a drive system 440 able to advance it over a given distance and along a determined feed path which notably passes through the platen press 300. This foil drive system 440 is chiefly made up, on the one hand, of a series of idling shafts 441, which are installed along the feed path to guide the movement of the foils 410, 411, 412, and on the other hand, of three advance shafts 442, 443, 444 which are positioned in the downstream part of said feed path in order respectively to drive each of said foils 410, 411, 412 along.

The process of processing the sheets in the stamping machine 1 ends at the delivery station 500 the main function of which is to form the already processed sheets back into a stack. To do that, the conveying device 600 is arranged to release each sheet automatically when the sheet comes into line with this new stack. The sheet then drops squarely onto the top of the stack.

In a conventional way, the conveying device 600 uses a series of gripper bars 610 mounted with transverse translational mobility via two gripper bar chains 620 arranged laterally along each side of the stamping machine 1. Each gripper bar chain 620 travels a loop which allows the gripper bars 610 to follow a trajectory that passes in succession through the platen press 300, the feed and discharge station 400 and the delivery station 500.

Figure 2:
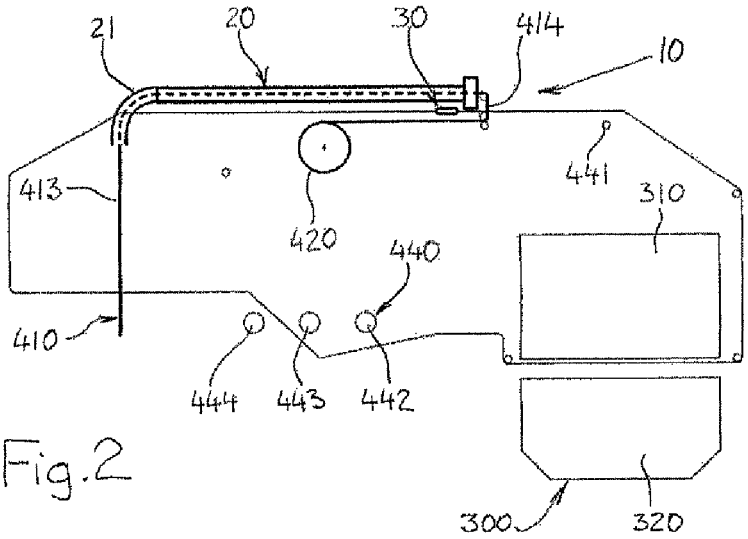
FIG. 2 depicts the foil insertion device at the moment when a stamping foil is being made ready to be introduced into the foil drive system.
Figure 3:
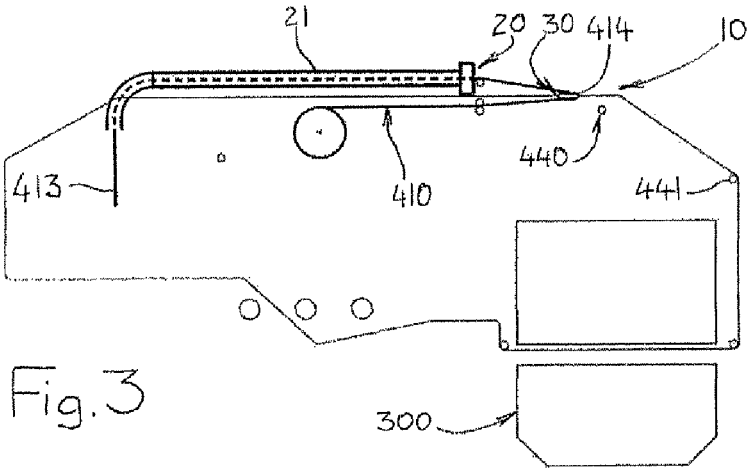
FIG. 3 is a view similar to FIG. 2 but with the foil in the process of being introduced into the foil drive system.
Figure 4:
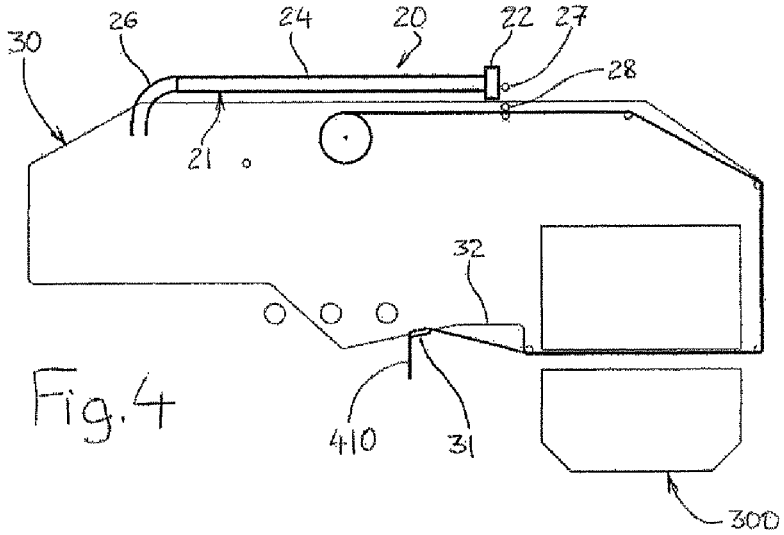
FIG. 4 is a view similar to the FIGS. 2 and 3, but with the foil at the end of introduction to the foil drive system.

As can be seen in FIGS. 2 to 4, the stamping machine 1 further has an insertion device 10 allowing each stamping foil 410, 411, 412 to be introduced into the foil drive system 440, and notably to be passed through the platen press 300. It should be noted here that in these figures, and for the sake of clarity, only the stamping foil 410 has been depicted in order to illustrate the principle of operation of the insertion device.

According to the subject matter of the present invention, the foil is unwound sufficiently for its leading end to be brought by some means or by hand toward a holding means 20. The insertion device 10 is first of all provided with holding means 20 which are able to hold each foil 410, 411, 412 in a position known as the insertion position in which the then leading end portion of said foil 410, 411, 412 is turned back on itself to constitute the free strand 413 of an open loop 414 (FIG. 2). The insertion device 10 is also provided with deployment means 30 which are able to unwind each free strand 413 along the feed path by pulling the corresponding foil 410 from the inside of its loop 414 (FIG. 3). Finally, the assembly is arranged in such a way that the holding means 20 are also capable of partially restraining the free strand 413 of each loop 414 as it is unwound by the deployment means 30 (FIG. 3).

Eventually, the deployment means 30 gradually withdraws the free strand 413 from the holding means as shown in successive FIGS. 2 and 3 and when it is finally withdrawn, the deployment means moves the free end 13 past the platen and the foil is then installed for printing.

As may be clearly seen in FIGS. 2 to 4, the holding means 20 are positioned upstream of the foil drive system 440, in a plane which is distinct from but substantially parallel to the plane in which each foil 410, 411, 412 arrives just before it is introduced into said foil drive system 440. This feature means that the effectiveness of the holding means 20 can be optimized in their holding and restraining functions, while at the same time encouraging overall compactness.

According to one particular feature of the invention, the holding means 20 comprise a suction member 21 which is able to apply a suction force to the free strand 413 of each foil 410, 411, 412 in a direction substantially the opposite of the direction in which said free strand 413 is deployed at the start of introduction. Of course, at this stage in the description, any type of suction may be envisioned for holding and restraining the free strand 413 of each stamping foil 410, 411, 412.

However, and according to one currently preferred embodiment of the invention, the suction member 21 is capable here of generating a sucked air flow using a Venturi effect, in a direction substantially the opposite of the direction in which each free strand 413 deploys at the start of introduction.

According to another advantageous particular feature of the invention, with each foil 410, 411, 412 being intended to be deployed along a feed path of given length, known as the feed length, the suction member 21 is capable initially of sucking up a length of free strand 413 that is substantially equal to twice the feed length. This feature means that each free strand 413 can be kept under tension until the corresponding loop 414 reemerges from the platen press 300. The precision with which each foil 410, 411, 412 can be put into place is thus significantly improved.

Figure 5:
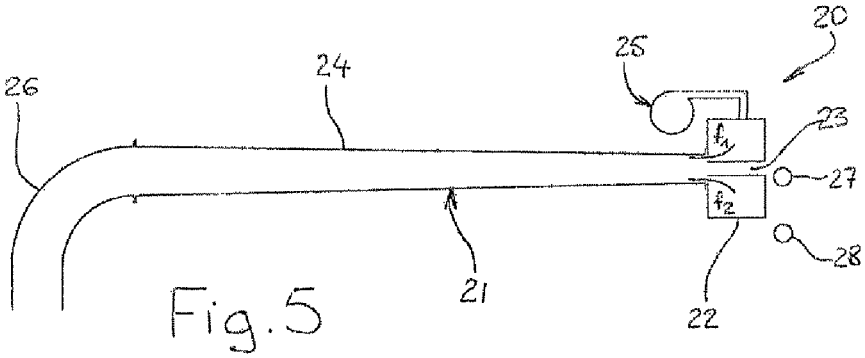
FIG. 5 shows in detail the holding means with which the foil insertion device is equipped.

As can be seen more clearly from FIG. 5, the suction member 21 is first of all provided with a suction head 22 through which is formed a suction duct 23 the task of which is to channel the sucked air flow. The suction member 21 is then provided with a suction plenum 24 which is secured to the back of the suction head 22, which communicates with the suction duct 23 and which is open at its other end, that is to say at the opposite end to the suction head 22. It will be noted that this suction plenum 24 is, however, closed at the sides to encourage the creation of a depression through a Venturi effect. The suction member 21 finally comprises blower means 25 which are capable of injecting pressurized air into the plenum 24. The whole thing is arranged in such a way that this injection (arrows f1 and f2) is from a region situated close to the internal end of the suction duct 23 and in a direction which is substantially parallel to said suction duct 23 while at the same time being direct toward the open end of the suction plenum 24.

In particularly advantageous way, the suction duct 23 has a flattened cross section which runs substantially parallel to the plane in which each foil 410, 411, 412 is introduced into the foil drive system 440. This feature means that the various free strands 413 can be simultaneously kept juxtaposed in one and the same plane and ultimately encourages uniform placement of the corresponding foils 410, 411, 412 in the foil drive system 440.

According to one advantageous specific feature perfectly visible in FIG. 5, the suction plenum 24 is in the shape of a wedge that widens from the suction head 22 to the open end of said plenum 24. The benefit of this geometric feature is that it makes the suction inside the plenum 24 uniform.

According to a currently preferred embodiment of the invention, the suction member 21 here is arranged in such a way that the blower means 25 are capable of generating two substantially laminar air flows which are injected substantially parallel to one another on each side of the suction duct 23 (FIG. 5). The fact that each air flow is substantially laminar means that it adopts somewhat of an air curtain form, that is to say the form of a flow the cross section of which is of a width very much greater than its height.

In any event, the concomitant flow of the two air flows injected into the plenum 24 creates, through a Venturi effect, a depression behind the suction duct 23 which depression in its turn generates an air flow sucked up through said suction duct 23. In practice, the blower means 25 may use a simple blower pump the flow of which is split to generate the two injected air flows, or may use two blower pumps respectively dedicated to the production of each injected air flow.

Particularly advantageously, the suction member 21 further comprises a deflector 26 which is positioned to the rear of and in the continuation of the suction plenum 24 and which is capable of channeling the free strand 413 of each foil 410, 411, 412 toward a dedicated temporary storage region. It must be understood here that the temporary storage region corresponds to an empty space in the stamping machine 1, which is available for storing the free strands 413 of the foils 410, 411, 412 until such time as implementation of the deployment means 30 is complete.

FIGS. 2 to 4 also clearly show that each foil 410, 411, 412 arrives at the entry to the foil drive system 440 in a plane, known as the insertion plane, that is substantially distinct from the plane in which the suction member 21 is positioned. This is why, advantageously, the insertion device 10 further comprises at least one diverting member 27, 28 capable of guiding the running of each foil 410, 411, 412 from their insertion plane to the plane in which the suction member 21 is positioned.

In this exemplary embodiment, each diverting member 27, 28 is in the form of an air-powered diverting member, that is to say a tube through which compressed air travels, and through the wall of which a plurality of orifices is pierced the purposes of these orifices being to allow said compressed air to escape. The air film thus created between the tube and each foil 410, 411, 412 limits the friction forces and therefore encourages slippage. Naturally, the number and position of diverting members 27, 28 will depend on the internal configuration of the stamping machine 1, but, in general, a diverting member 27, 28 will almost always be present at the entry to the suction member 21, tangential to the plane with respect to which the flattened suction duct 23 extends.

Once again, according to a currently preferred embodiment of the invention, the deployment means 30 comprise a pull bar 31 which is, on the one hand, mounted with transverse translational mobility in a movement trajectory a portion of which is substantially parallel to the feed path and which is, on the other hand, capable of sitting inside the loop 414 of each stamping foil 410, 411, 412. At this stage in the description, it must be understood that the dynamics of the movement of the pull bar 31 may just as well correspond to a reciprocating movement in an open loop trajectory as it may a continuous movement in a closed loop trajectory.

However, and once again according to a preferred embodiment of the invention, the movement trajectory of the pull bar 31 describes a closed loop a portion of which runs alongside the feed path of each foil 410, 411, 412. As seen in FIGS. 3 and 4, the pull bar moves the free strand 413 of the foil 410, 411, 412 through the press where the foil is positioned for subsequent application to a blank.

In this exemplary embodiment, the pull bar 31 is mounted with transverse translational mobility via two chain sets 32 which are secured respectively to the two ends of said pull bar 31 and which are positioned laterally on each side of the stamping machine 1.

Of course, the invention relates more generally to any stamping machine 1 comprising a foil drive system 440 capable of progressing at least one stamping foil 410, 411, 412 in a determined feed path and further comprising a foil insertion device 10 as described hereinabove.

The invention claimed is:

1. An insertion method for introducing at least one elongate stamping foil into a foil drive system of a stamping machine for advancing each foil in a determined feed path, the method comprising the steps of:

providing an end portion of each foil over a given length;

turning each end portion of foil back on itself to constitute a free strand of an open loop of each foil, the loop having an inside of the loop;

deploying each free strand along its feed path by pulling on the corresponding foil from the inside of its loop; and partially restraining each free strand as the free strand deploys along the feed path.

2. The insertion method according to claim 1, further comprising restraining each free strand by applying to it a suction force which is directed in a direction substantially opposite a direction in which the free strand deploys at the start of introduction.

3. The insertion method of claim 1, wherein while pulling on the foil from inside the loop, pulling the free strand out of the holding device against the partial restraint thereof and then advancing the free strand along the feed path.

4. The insertion method of claim 3, further comprising restraining each free strand by applying to it a suction force which is directed in a direction substantially opposite a direction in which said free strand deploys at the start of introduction.

5. An insertion device for introducing at least one elongate stamping foil into a foil drive system of a stamping machine, wherein the drive system is configured for advancing each foil in a determined feed path;

the insertion device comprising:

a holding device configured and located for holding each foil in an insertion position, in which a then leading end portion of the foil is turned back on itself to constitute a free strand of an open loop;

a deploying device configured and located for deploying each free strand along the feed path by pulling on the corresponding foil from inside of its loop; and the holding device is further configured for partially restraining each free strand as the deployment device deploys each strand.

6. The insertion device according to claim 5, wherein the holding device is positioned upstream of the foil drive system in the feed path and in a plane distinct from but substantially parallel to a plane in which each foil arrives at the holding device just before each foil is introduced into the foil drive system.

7. The insertion device according to claim 5, wherein the holding device comprises a suction member configured for applying a suction force to the free strand of each foil in a second direction substantially opposite a first direction in which each free strand is deployed at the start of introduction.

8. The insertion device according to claim 7, wherein the suction member is configured for generating a sucked air flow using a Venturi effect, and the sucked air flow is in the second direction substantially opposite the first direction in which each free strand starts to deploy at the start of introduction.

9. The insertion device according to claim 8, wherein the deploying device is configured to deploy each foil along a feed length that is a feed path of given length, and the suction member is configured for initially sucking up a length of the free strand that is substantially equal to twice the feed length.

10. The insertion device according to claim 7, wherein the suction member comprises a suction head through which a suction duct is formed, a suction plenum secured to the back of the suction head communicates with the suction duct, and the suction plenum is open at its other end; and a blower device located and configured for injecting pressurized air into the plenum, from a region situated close to an internal end of the suction duct and in a direction substantially parallel to the suction duct, while at the same time being directed toward the open end of the suction plenum.

11. The insertion device according to claim 10, wherein the suction duct has a flattened cross section which runs substantially parallel to the plane in which each foil is introduced into the foil drive system.

12. The insertion device according to claim 10, wherein the suction plenum is in the shape of a wedge that widens from the suction head to the open end of the suction plenum.

13. The insertion device according to claim 10, wherein the blower device is configured for generating two substantially laminar air flows and for injecting the two flows substantially parallel to each other and on each side of the suction duct.

14. The insertion device according to claim 10, wherein the suction member further comprises a deflector which is positioned to the rear of and in a continuation of the suction plenum and which is configured for channeling the free strand of each foil toward a temporary storage region.

15. The insertion device according to claim 7, configured such that each foil arrives at the entry to the foil drive system in a second insertion plane, which is substantially distinct from a first plane in which the suction member is positioned; and the insertion device further comprises at least one diverting member located and configured for guiding running of each foil from the second insertion plane to the first plane in which the suction member is positioned.

16. The insertion device according to claim 7, wherein the deployment device comprises a pull bar, mounted with transverse translational mobility in a movement trajectory having a portion which is substantially parallel to the feed path and the pull bar is located inside the loop of each foil.

17. The insertion device according to claim 16, wherein the pull bar has a movement trajectory that describes a closed loop having a loop portion that runs alongside the feed path of each foil.

18. The insertion device according to claim 17, wherein the pull bar is mounted with transverse translational mobility via two chain sets which are secured respectively to two ends of the pull bar and which are positioned laterally on each side of the stamping machine.

19. A stamping machine comprising a foil drive system configured for advancing at least one stamping foil in a determined feed path, and comprising an insertion device according to claim 5.

* * * * *